US005647143A

United States Patent [19]

Kubota et al.

[11] Patent Number: 5,647,143

[45] Date of Patent: Jul. 15, 1997

[54] VACUUM-DEGREASING CLEANING METHOD

[75] Inventors: Ken Kubota, Nagoya; Kunihiko Ishikawa, Anjo; Noboru Hiramoto, Inuyama, all of Japan

[73] Assignee: Japan Hayes Ltd., Aichi, Japan

[21] Appl. No.: 583,463

[22] Filed: Jan. 5, 1996

Related U.S. Application Data

[63] Continuation of Ser. No. 128,213, Sep. 29, 1993, abandoned.

[30] Foreign Application Priority Data

Oct. 30, 1992 [JP] Japan ..... 4-293478

[51] Int. Cl.[6] ..... B08B 3/08

[52] U.S. Cl. ..... 34/410; 34/406; 34/92

[58] Field of Search ..... 34/406, 407, 408, 34/409, 410, 412, 92

[56] References Cited

U.S. PATENT DOCUMENTS 4,530,165 7/1985 Tiedemann ..... 34/32
5,143,102 9/1992 Blaul ..... 34/58 R
5,203,927 4/1993 Yoshida et al. ..... 134/21
5,222,307 6/1993 Oba et al. ..... 34/404 X
5,240,507 8/1993 Gray et al. ..... 134/21
5,315,766 5/1994 Roberson et al. ..... 34/409

FOREIGN PATENT DOCUMENTS 56-115676 9/1981 Japan .

*Primary Examiner*—William Doerrler
*Attorney, Agent, or Firm*—Salter & Michaelson

[57] ABSTRACT

Herein disclosed are a vacuum-degreasing cleaning method for degreasing a work by cleaning it with a solvent vapor under reduced pressure, and a vacuum-cleaning machine for practicing the method. This method comprises the vapor-cleaning step of cleaning the work under reduced pressure with a vapor of a petroleum solvent, and the drying step of drying the surface of the work under reduced pressure. This cleaning method can clean the work while preventing the deterioration of the working atmosphere and the air pollution and can reduce the initial cost and the running cost for the work cleaning operation. Moreover, the cleaning efficiency can be safely enhanced with neither any thermal influence upon nor any rust upon the work.

17 Claims, 6 Drawing Sheets

VACUUM-DEGREASING CLEANING METHOD

BACKGROUND OF THE INVENTION

This application is a continuation of Ser. No. 08/128,213 filed Sep. 29, 1993, now abandoned.

1. Field of the Invention

The present invention relates to a vacuum-degreasing cleaning method of vapor-cleaning works such as mechanical parts made of metals or synthetic resins, heat-treated parts or plated parts under reduced pressure.

2. Description of the Prior Art

In the prior art, the works are vacuum-cleaned with a chlorine solvent such as 1,1,1-trichloroethane or a fluorine solvent such as Freon 113. This is because these solvents have high cleaning efficiencies.

However, the chlorine solvent is so toxic that, if used, it will deteriorate the working atmosphere.

On the other hand, the fluorine solvent, if used, will damage the ozone layer to cause an air pollution over a wide range.

In case these solvents are used, effluent treating facilities are required for preventing the air pollution. Moreover, these solvents are so volatile that they cannot be prevented from diffusing into the atmosphere while the works are carried into and out of the cleaning chamber. As a result, 50 to 70% of the usage cannot be recovered.

Thus, the use of those solvents has raised the initial cost or the running cost for the cleaning operation.

Incidentally, the solvent vapor may be liquefied for recovery so as to prevent the diffusion into the atmosphere. For this recovery, a cooling coil may be arranged at the opening of the cleaning chamber. With these constructions, however, the solvent vapor will largely migrate when a large work is carried in or out, so that it cannot be prevented from diffusing into the atmosphere.

Still moreover, the chlorine solvent is difficult to evaporate for regeneration, and its use is wasteful. This will be reasoned in the following. If fats and oils to be cleared from the works are mixed 30% or more in the solvent, the boiling point will rise so that the solvent decomposes to release chlorine gas. This makes it necessary to replace the solvent when the mixed percentage of the fats and oils in the solvent exceeds 30%, thus making the evaporating regeneration impossible.

Furthermore, the works may rust with the chlorine solvent used. This will be reasoned in the following. The solvent is liable to include the water droplets, which are produced on the cooling coil disposed in the opening of the cleaning chamber, the water content in a water-soluble cutting agent or the moisture such as frost after a subzero treatment. Then, an azeotropy will occur in the chlorine solvent due to the inclusion of the water. With this azeotropy, the mixed solvent boils at a lower temperature than that of the pure solvent so that water vapor containing chlorine is generated. The works will rust when the water vapor containing chlorine condenses on the surfaces of them.

SUMMARY OF THE INVENTION

In order to solve the problems described above, therefore, an object of the present invention is to provide a vacuum-degreasing cleaning method capable of preventing the deterioration in the working atmosphere or capable of preventing air pollution.

Another object of the present invention is to provide a vacuum-degreasing cleaning method capable of reducing the initial cost and the running cost.

Still another object of the present invention is to provide a vacuum-degreasing cleaning method capable of cleaning works troublelessly in an enhanced efficiency.

In order to achieve these objects, according to the present invention, there is provided a vacuum-degreasing cleaning method, by which a work is cleaned under reduced pressure with the vapor of a petroleum solvent so that it may be degreased.

The above-specified petroleum solvent may preferably have a cleanability of the third grade solvent of the fourth group. Such solvent is defined as having a flash point higher than 70° C. This is because the solvent of this kind is permitted to stock as much as 2,000 liters according to the Fire Services Act. This petroleum solvent is generally called the "cleaning solvent", as can be exemplified by "CLEAN SOL G" (of Nippon Petroleum Co., Ltd.) or "DUFNIE SOLVENT" (of Idemitsu Petroleum Co., Ltd.).

On the other hand, the pressure in the cleaning chamber is reduced according to the petroleum solvent used and the work. In case the work is made of steel, for example, the pressure is so reduced that the boiling point of the petroleum solvent used may drop to around 140° C. or the tempering temperature of the work. In case the work is made of a synthetic resin, on the other hand, the pressure is so reduced that the boiling point of the petroleum solvent may drop to the thermal deformation temperature or less of the work. The pressure reduction is generally within a range of 5 to 100 Torrs, which should not be limited thereto in dependence upon the petroleum solvent used.

In the vacuum-degreasing cleaning method according to the present invention, the work is cleaned under the reduced pressure with the vapor of the petroleum solvent used. In the cleaning operation, the vapor of the petroleum solvent will wet the work surface at the room temperature to dissolve and clear the fats and oils to clean the work. This cleaning operation is continued until the work reaches the evaporation temperature of the solvent.

In the vacuum-degreasing cleaning method according to the present invention, moreover, the solvent used for the vapor cleaning belongs to the petroleum solvent so that it is hardly toxic and is harmless unlike the chlorine solvent or the fluorine solvent of the prior art. According to the present invention, therefore, the work can be cleaned without using any effluent facilities, while preventing the deterioration of the working atmosphere and the air pollution.

Thanks to the vapor cleaning under the reduced pressure, moreover, the solvent can prevail all the corners of the work to clean it excellently.

Furthermore, the petroleum solvent can be recovered substantially wholly unlike the chlorine or fluorine solvent. This is because the petroleum solvent has a specific volatility of 1/300 to 1/600 so that it is reluctant to volatilize. And, the volatile content is negligible, if the work is carried in and out of the cleaning chamber after the atmospheric pressure has been restored or the work has been cooled down while preventing the evaporation.

Furthermore, the petroleum solvent used can maintain its high cleaning efficiency for a long time without being replaced. This will be reasoned in the following. When the petroleum solvent is to be evaporated under the reduced pressure, the difference in the specific volatility between the petroleum solvent and the fats and oils to be mixed into the former grows the more as the pressure is reduced to the lower level. Specifically, even after the petroleum solvent having been used for the cleaning operation is soiled by the work into a liquid mixed with the fats and oils, the content of the highly pure petroleum solvent can be evaporated. Thus, the petroleum solvent can maintain Its high cleaning efficiency for a long time without being replaced, so that it can drop the running cost.

Incidentally, the petroleum solvent can be used on principle for the vapor cleaning operation even if it is soiled with 99.9% or more of the fats and oils. For practical purposes, however, it is desired because of the evaporation cost or the tact time that the petroleum solvent cleans the work until it is soiled with about 70% of the fats and oils.

Because of the vapor cleaning under the reduced pressure, furthermore, the boiling point of the petroleum solvent to be evaporated drops. As a result, the heat source to be used and the facilities considered to work out a countermeasure for the thermal expansion of the cleaning chamber can be simple ones. Thus, the present invention can reduce the initial cost.

By the vacuum-degreasing cleaning method according to the present invention, furthermore, the work can be cleaned without being thermally influenced. This is because the cleaning method of the present invention is carried with the vapor under the reduced pressure. Thus, the boiling point of the petroleum solvent drops so that the work can be cleaned at a temperature below the tempering value or the thermally deforming value even if it is made of steel or a synthetic resin.

Furthermore, the cleaning method of the present invention can keep the work rustless. This is partly because the petroleum solvent is free from the azeotropy even if water is included thereinto and partly because the water, if having wetted the work, will volatilize under the reduced pressure before the petroleum evaporates.

According to the cleaning method of the present invention, furthermore, the work can be safely cleaned. This is partly because the petroleum solvent is evaporated after the evacuation (to 5 to 100 Torrs, for example), so that the oxygen necessary for the ignition is drastically reduced. Partly because the cleaning chamber is constructed of a sealed structure to maintain the reduced pressure so that the spontaneous ignition of the petroleum solvent is suppressed.

Incidentally, this ignition can also be prevented when the cleaned work is taken out. Specifically, if an inert gas such as nitrogen gas is introduced to restore the pressure, the oxygen content drops, and the evaporated petroleum solvent is liquefied by the pressure rise so that the ignition can be prevented at the time of taking out the work, too.

As a result, according to the vacuum-degreasing cleaning method of the present invention, the work can be cleaned while preventing the deterioration of the working atmosphere and the air pollution. According to the method of the present invention, moreover, it is possible to reduce the initial cost and the running cost for cleaning the work. Thus, according to the method of the present invention, the work can be cleaned safely in the high efficiency while being freed from any thermal influence and any rust.

DESCRIPTION OF THE PREFERRED EMBODIMENTS

The present invention will be described in the following in connection with its embodiments with reference to the accompanying drawings, but should not be limited to the embodiments. All the modifications within the components of the appended claims and their equivalents should be included in the scope of the claims.

Figure 1:
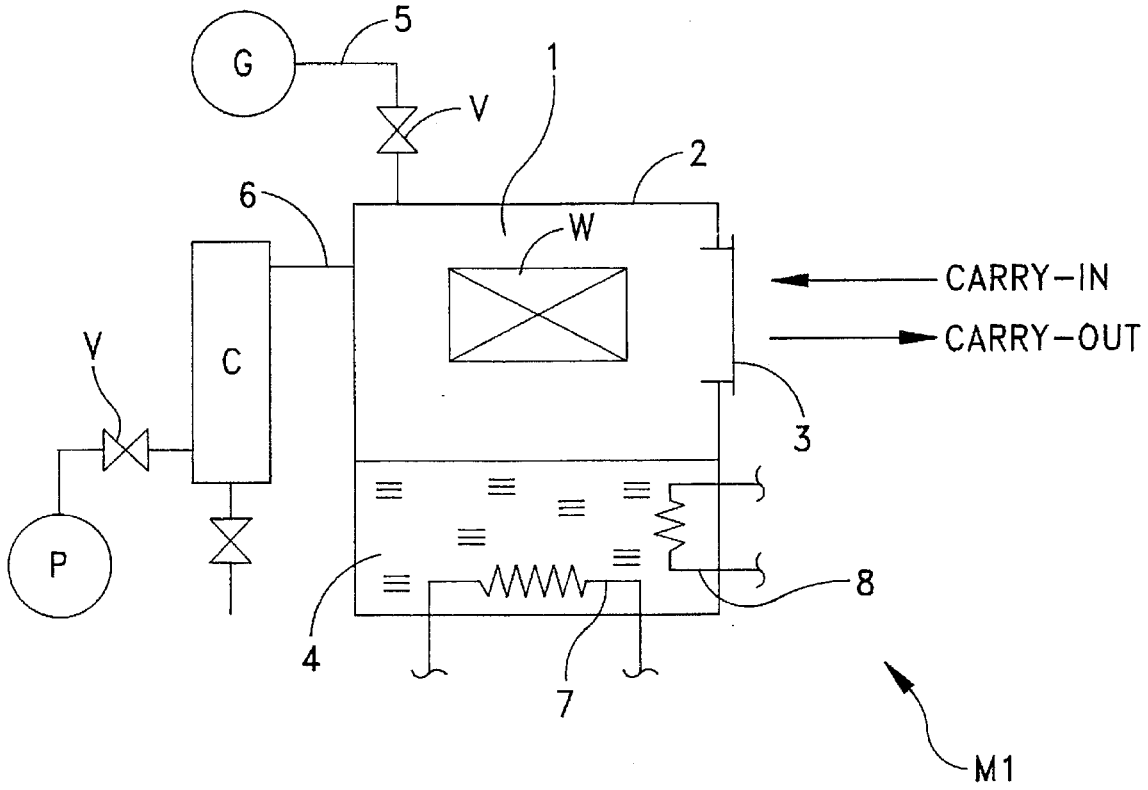
FIG. 1 is a schematic diagram showing a vacuum cleaning machine to be used in one embodiment of the present invention.

In a vacuum-cleaning machine M1 to be used in an embodiment, as shown in FIG. 1, a cleaning chamber 1 has its surrounding wall constructed of a vacuum container 2. This vacuum container 2 is arranged with a door 3 for carrying in/out a work W.

The cleaning chamber 1 is arranged in its upper portion with a not-shown table for placing the work W thereon. The cleaning chamber 1 is reserved with a petroleum solvent 4 in its lower portion.

To the cleaning chamber 1, on the other hand, there are connected pipes 5 and 6. These pipes 5 and 6 in turn are connected to an inert gas source G and a vacuum pump P acting as a pressure reducing source, respectively. Incidentally, Letters V and C designate a solenoid valve and a condenser, respectively.

The cleaning chamber 1 is further arranged in its lower portion with a heater 7. This heater 7 is used to heat the petroleum solvent 4. Further arranged in the lower portion of the cleaning chamber 1, there is arranged a cooling coil 8 for cooling the petroleum solvent 4.

Figure 2:
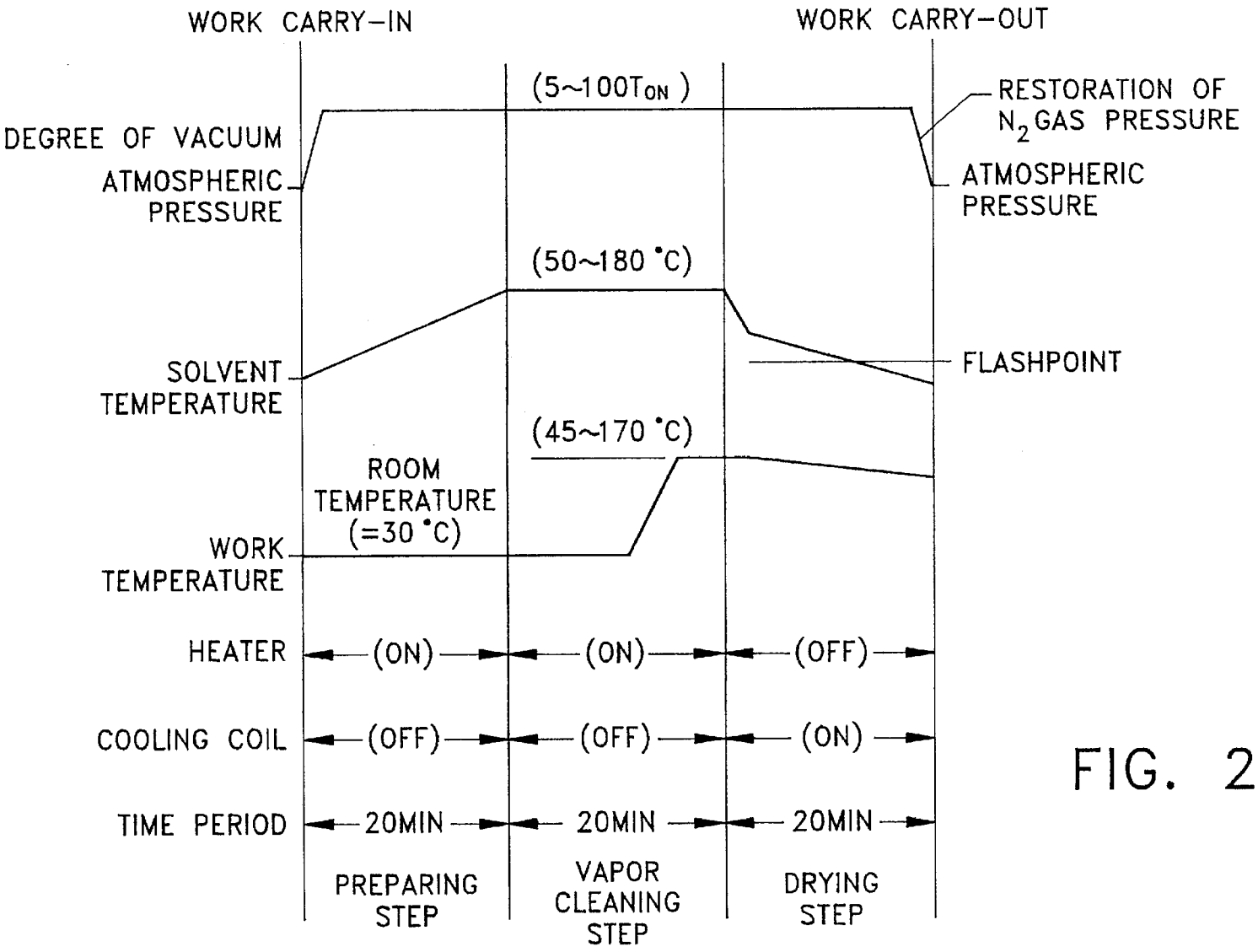
FIG. 2 is a process chart showing one cycle of the embodiment.

In case the work W is to be cleaned by the vacuum-cleaning machine M1 thus constructed, the three steps of preparing, vapor-cleaning and drying are followed, as shown in a process chart of FIG. 2.

First of all, at the preparing step, the work W is placed on the not-shown table in the cleaning chamber 1 by opening the door 3. After this door 3 has been closed, the pressure in the cleaning chamber 1 is reduced to 5 to 100 Torrs. Then, the petroleum solvent 4 is heated by the heater 7.

At the next vapor-cleaning step, the petroleum solvent 4 is heated to 50° to 180° C. by the heater 7. Then, the cleaning chamber 1 is filled up with the solvent vapor so that the work W is cleaned with the vapor. At this time, the work W is heated from about 30° C. of the room temperature to 45° to 170° C.

In this meanwhile, the vapor of the petroleum solvent 4 wets the surface of the work W being heated from the room temperature. As a result, the surface solvent dissolves the fats and oils to clean the work W. This cleaning operation is continued until the work W reaches the vapor temperature of the solvent 4.

At the final drying step, the heating of the heater 7 is stopped. And, cold water is supplied to the cooling coil 8 to cool the petroleum solvent 4 and to dry the surface of the work W. Then, the cleaning chamber 1 is supplied with the nitrogen gas or the like from the inert gas source G to cause the cleaning chamber 1 to restore the atmospheric pressure. After this, the door 3 is opened to carry out the cleaned work W, thus ending the cleaning operation of the work W.

Incidentally, the pressure in the cleaning chamber 1 and the temperature, to which is heated the solvent 4, are suitably set according to the kind of the solvent 4.

Incidentally, the "CLEAN SOL G" (of Nippon Petroleum Co., Ltd.), if used as the petroleum solvent 4, has a flashpoint of 75° C. and a boiling point of 194° to 216° C. under the atmospheric pressure and 90° to 120° C. under 60 Torrs. Therefore, the pressure in the cleaning chamber 1 is reduced to 60 Torrs, and the solvent 4 is heated to 120° C. for the vapor cleaning operation (then the work W is heated to about 110° C.). After this, the solvent 4 may be cooled to a temperature such as 65° C. lower than its flashpoint by the time the work W is carried out.

On the other hand, the cleaning machine to be used can be exemplified by vacuum-cleaning machines M2, M3, M4, M5 and M6, as shown in FIGS. 3 to 7.

Figure 3:
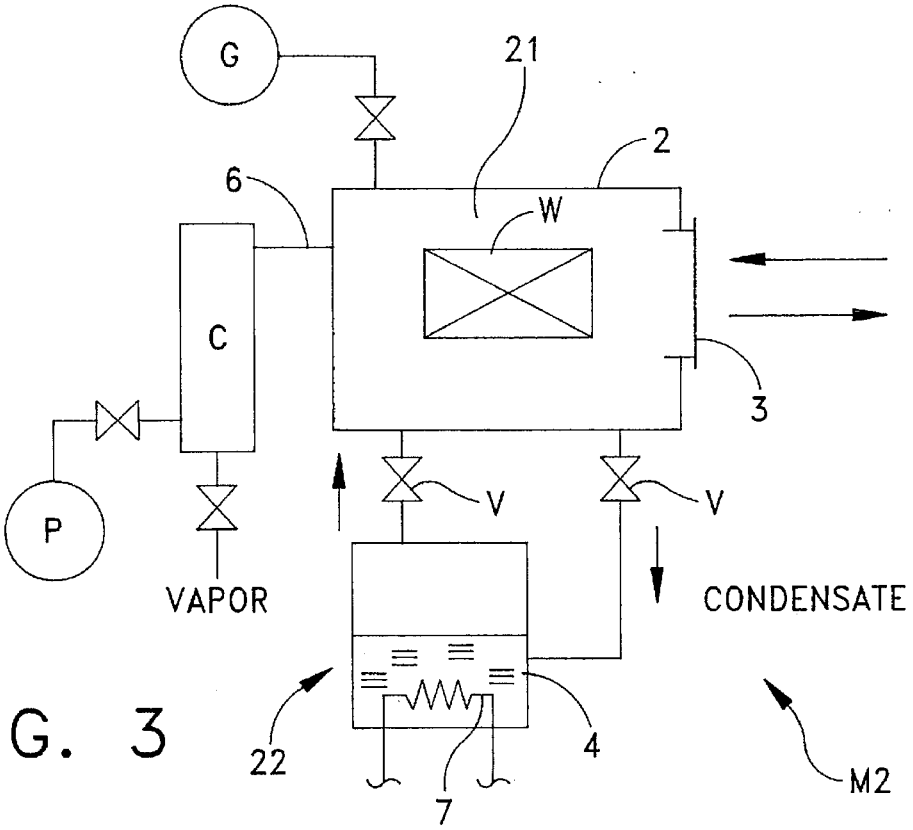
FIG. 3 is a schematic diagram showing another vacuum cleaning machine.

In the vacuum-cleaning machine M2 shown in FIG. 3, a portion 22 for generating the vapor of the solvent 4 is separated from a cleaning chamber 21. In case, moreover, this vacuum-cleaning machine M2 is used, the work W is cleaned at the two steps of vapor-cleaning and drying steps.

When this vacuum-cleaning machine M2 is used, the solvent 4 is heated in advance by the heater 7 to generate its vapor in the vapor generator 22.

At the vapor-cleaning step, the work W is placed on the not-shown table in the cleaning chamber 21 by opening the door 3. After this door 3 has been closed, the pressure in the cleaning chamber 21 is reduced to 5 to 100 Torrs, and the righthand and lefthand solenoid valves V are opened. Then, the cleaning chamber 21 is filled up with the solvent vapor which is supplied through the lefthand solenoid valve V to clean the work W with that vapor.

In this meanwhile, the solvent having dissolved the fats and oils is returned from the righthand solenoid valve V to the vapor generator 22 so that it is circulated for reuse.

At the final drying step, the solenoid valves V are closed to dry the surface of the work W. Then, the cleaning chamber 21 is supplied with the nitrogen gas or the like from the inert gas source G to restore the atmospheric pressure. When the door 3 is then opened to carry out the cleaned work W, the work cleaning operation can be ended.

In case the vapor generator 22 and the cleaning chamber 21 are separated as in this vacuum-cleaning machine M2, the tact time can be shortened to two thirds of that of the case in which the vacuum-cleaning machine M1 is used. This will be reasoned in the following. Since the solvent vapor is always generated by the vapor generator 22, the vapor-cleaning step can be executed if the lefthand solenoid valve V is opened at a predetermined time. As a result, the preparing step of heating the solvent 4 in the case of using the vacuum-cleaning machine M1 can be omitted in the case of using the vacuum-cleaning machine M2.

In the case of this vacuum-cleaning machine M2, moreover, the work W can be cleaned with less energy than that of the case of the vacuum-cleaning machine M1. This is because the solvent vapor is always generated in the vapor generator 22 so that the solvent 4 need not be heated/cooled in each cycle for cleaning the work W with the vapor.

Incidentally, the vapor generator 22 is enabled to generate the solvent vapor in high purity by vacuum-evaporating the solvent 4. Moreover, the temperature management and the replacement of the solvent 4 can be facilitated because the vapor generator 22 is separate from the cleaning chamber 21.

In case the solvent 4 used is exemplified by the aforementioned "CLEAN SOL G", it acquires a boiling point of 170° C. under 60 Torrs when the fat content included reaches 70%. This provides a measure for replacing the solvent 4 when the temperature in the vapor generator 22 reaches 170° C.

Figure 4:
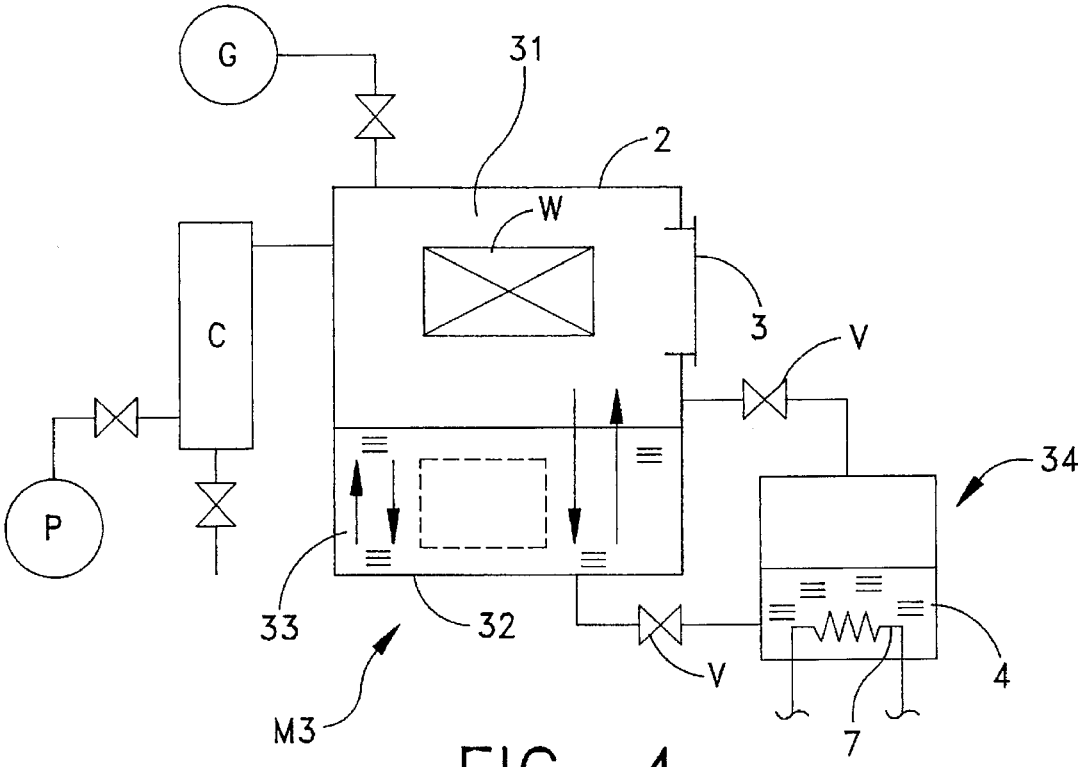
FIG. 4 is a schematic diagram showing still another vacuum cleaning machine.

The vacuum-cleaning machine M3 shown in FIG. 4 has its vapor generator 34 separated from a cleaning chamber 31. Moreover, the cleaning chamber 31 has its lower portion formed into a dipping bath 32. This dipping bath 32 is reserved with a dipping solvent 33 like the solvent 4. This vacuum-cleaning machine M3 is constructed such that the table for placing the work W in the cleaning chamber 31 can be vertically moved to dip and clean the work W at a stage before the vapor-cleaning step. In case this vacuum-cleaning machine M3 is used, the work W is cleaned at the two steps of vapor-cleaning and drying steps and is dipped and cleaned at the vapor-cleaning step.

In the case of using this vacuum-cleaning machine M3, the solvent 4 is heated in advance by the heater 7 to generate its vapor in the vapor generator 34

At the vapor-cleaning step, the work W is placed on the not-shown table in the cleaning chamber 31 by opening the door 3. After this door 3 has been closed, the pressure in the cleaning chamber 31 is reduced to 5 to 100 Torrs. After this, the not-shown table is moved up and down several times to clean the work W in the dipping bath 32. After this, the table is lifted again, and the upper and lower solenoid valves V are opened. Then, the cleaning chamber 31 is filled up with the solvent vapor supplied from the upper solenoid valve V, to clean the work W with that vapor. At this time, the solvent having dissolved the fats and oils drops into the dipping bath 32 and is returned from the lower solenoid valve to the vapor generator 34 so that it is circulated for reuse.

At the final drying step, the solenoid valves V are closed to dry the surface of the work W. Then, the cleaning chamber 31 is supplied with the nitrogen gas or the line from the inert gas source to restore the atmospheric pressure. After this, the work cleaning operation can be ended by opening the door 3 to carry out the cleaned work W.

In case this vacuum-cleaning machine M3 is used, the cleaning time period is increased by 5 to 20 minutes to the case of using the vacuum-cleaning machine M2, because the work W is dipped and cleaned at the vapor-cleaning step. In the case of using the vacuum-cleaning machine M3, however, the cleaning efficiency is better than that of the case using the vacuum-cleaning machine M2. Thus, this vacuum-cleaning machine M3 finds its suitable application for the work W heavily soiled with the fats and oils, the work W soiled with a less soluble material such as grease, or the work W formed with many holes such as threaded holes.

Incidentally, the dipping solvent 33 has its temperature controlled to a level lower than its flashpoint. In case, moreover, the work W is heavily soiled, it may be rocked, while being dipped in the dipping solvent 33, by making use of the not-shown table.

Figure 5:
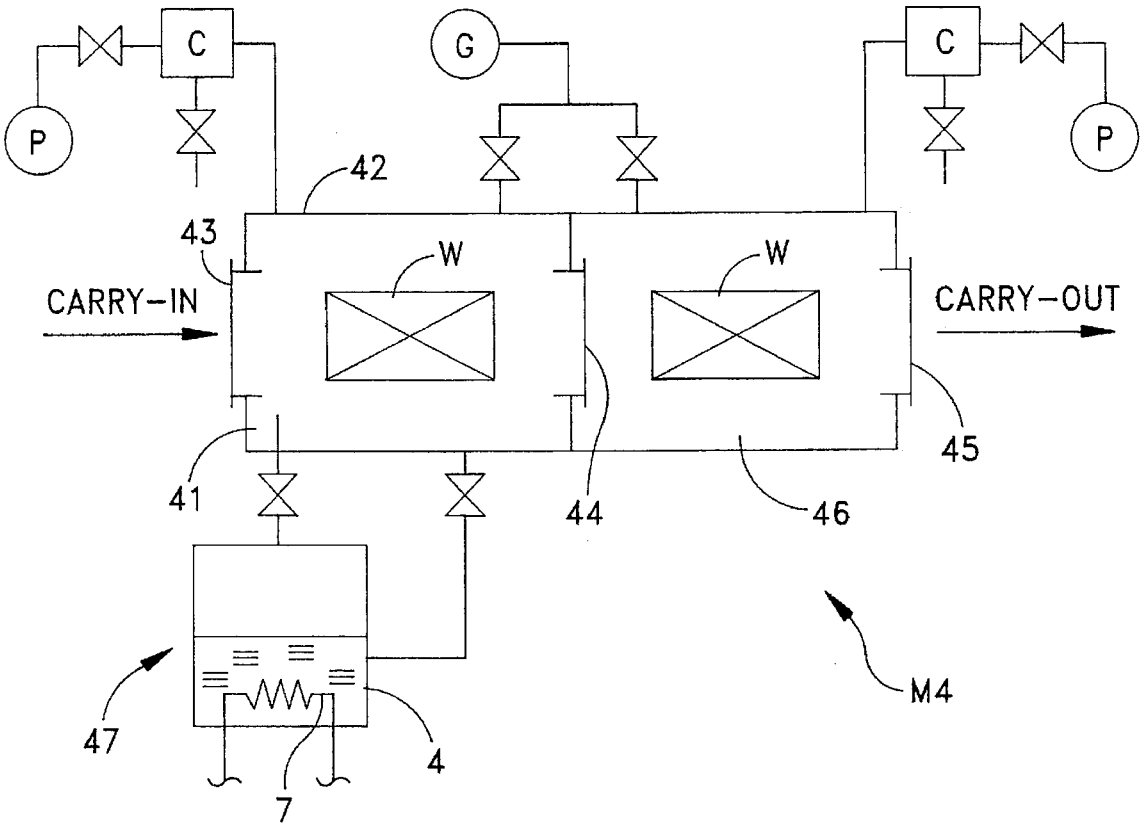
FIG. 5 is a schematic diagram showing a further vacuum cleaning machine.

The vacuum-cleaning machine M4 shown In FIG. 5 has its vacuum container 42 equipped with a carry-in door 43, an intermediate door 44 and a carry-out door 45. Moreover, the vacuum container 42 is partitioned into two chambers of a cleaning chamber 41 and a drying chamber 46, and a vapor generator 47 for the solvent 4 is connected to the cleaning chamber 41. Specifically, in case this vacuum-cleaning machine M4 is used, the work W is cleaned at two steps of vapor-cleaning step and drying step, and the succeeding work W is vapor-cleaned while the preceding work W is being dried.

In case this vacuum-cleaning machine M4 is used, the solvent 4 is heated in advance by the heater 7 to generate its vapor in the vapor generator 47.

First of all, at the vapor-cleaning step, the work W is placed on the not-shown table in the cleaning chamber 41 by opening the carry-in door 43. After this door 43 has been closed, the pressure in the cleaning chamber 41 is reduced to 5 to 100 Torrs. After this, the righthand and lefthand solenoid valves V and V are opened. Then, the cleaning chamber 41 is filled up with the solvent vapor supplied from the lefthand solenoid valve V, to clean the work W with that vapor.

At this time, the solvent having dissolved the fats and oils is returned through the righthand solenoid valve V to the vapor generator 47 so that it is circulated for reuse.

At the next drying step, the solenoid valves V and V are closed, and the pressure in the drying chamber 46 is reduced to 5 to 100 Torrs. Then, the intermediate door 44 is opened and closed to transfer the work W to the drying chamber 46 to dry the surface of the work W. Then, the drying chamber 46 is supplied with the nitrogen gas or the like from the inert gas source G so that it restores the atmospheric pressure. After this, the work rinsing operation can be ended by opening the carry-out door 45 to carry out the cleaned work W.

While the drying chamber 46 is drying the work W, the cleaning chamber 41 is supplied with the nitrogen gas from the inert gas source G so that it restores the atmospheric pressure. Then, the carry-in door 43 is opened and closed to carry the succeeding work W onto the not-shown table in the cleaning chamber 41. After this, the pressure in the cleaning chamber 41 is reduced, and the solenoid valves V and V are opened to clean the succeeding work W with the solvent vapor.

After the preceding work W has been carried out of the drying chamber 46, the succeeding works W are sequentially transferred to the drying step so that they may be dried.

The tact time in the case of using this vacuum-cleaning machine M4 can be shortened to one third of that in the case of using the vacuum-cleaning machine M1. This is partly because the preparing step of heating the solvent can be eliminated in the case of the vacuum-cleaning machine M4 unlike the case of the vacuum-cleaning machine M1 and partly because the succeeding works W can be cleaned at the vapor-cleaning step during the drying step of the preceding work W.

Figure 6:
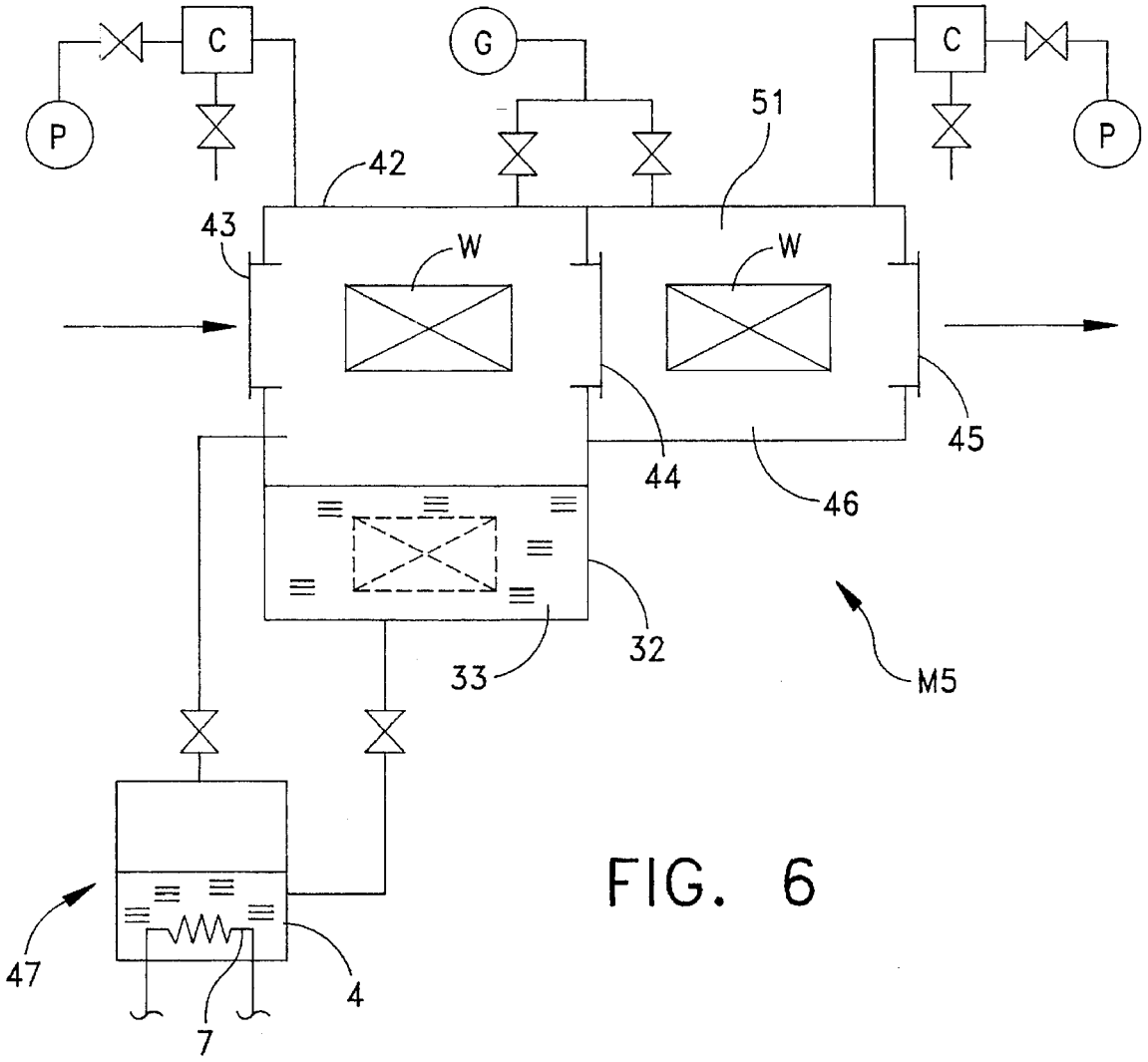
FIG. 6 is a schematic diagram showing a further vacuum cleaning machine.

The vacuum-cleaning machine MS shown in FIG. 6 is constructed such that a cleaning chamber 51 is equipped with the dipping bath 32 in the lower portion of the cleaning chamber 42 of the vacuum-cleaning machine M4. The dipping bath 32 is reserved with the dipping solvent 33 similar to the solvent 4. In case this vacuum-cleaning machine M5 is used, the work W is additionally dipped and cleaned during the vapor-cleaning step of the case using the vacuum-cleaning machine M4.

In case this vacuum-cleaning machine M5 is used, the solvent 4 is heated in advance by the heater 7 to generate its vapor in the vapor generator 47.

First of all, at the vapor-cleaning step, the work W is placed on the not-shown table in the cleaning chamber 51 by opening the carry-in door 43. After this door 43 has been closed, the pressure in the cleaning chamber 51 is reduced to 5 to 100 Torrs. And, the not-shown table is moved up and down several times to dip and clean the work W in the dipping bath 32 and is then lifted again. After this, the righthand and lefthand solenoid valves V and V are opened. Then, the cleaning chamber 51 is filled up with the solvent vapor supplied from the lefthand solenoid valve V, to clean the work W with that vapor.

At this time, the solvent having dissolved the fats and oils is returned through the righthand solenoid valve V to the vapor generator 47 so that it is circulated for reuse.

At the next drying step, the solenoid valves V and V are closed, and the pressure in the drying chamber 46 is reduced to 5 to 100 Torrs. Then, the intermediate door 44 is opened and closed to transfer the work W to the drying chamber 46 to dry the surface of the work W. Then, the drying chamber 46 is supplied with the nitrogen gas or the like from the inert gas source G so that it restores the atmospheric pressure. After this, the work rinsing operation can be ended by opening the carry-out door 45 to carry out the cleaned work W.

While the drying chamber 46 is drying the work W, the cleaning chamber 51 is supplied with the nitrogen gas from the inert gas source G so that it restores the atmospheric pressure. Then, the carry-in door 43 is opened and closed to carry the succeeding work W onto the not-shown table in the cleaning chamber 51. After this, the pressure in the cleaning chamber 51 is reduced to dip and clean the succeeding work W by moving the not-shown table up and down, and the solenoid valves V and V are opened to clean the succeeding work W with the solvent vapor.

After the preceding work W has been carried out of the drying chamber 46, the succeeding works W are sequentially transferred to the drying step so that they may be dried.

In case this vacuum-cleaning machine M5 is used, the dipping and cleaning actions are added to the vapor-cleaning step at the time of using the vacuum-cleaning machine M4 so that the cleaning efficiency of the work W can be enhanced better than the case of using the vacuum-cleaning machine M4.

Moreover, this vacuum-cleaning machine M5 can have its tact time shortened to two thirds of that of the vacuum-cleaning machine M3 because the preceding work W can be subjected to the drying step while the succeeding work W is being dipped and cleaned or cleaned with the vapor at the vapor-cleaning step.

Figure 7:
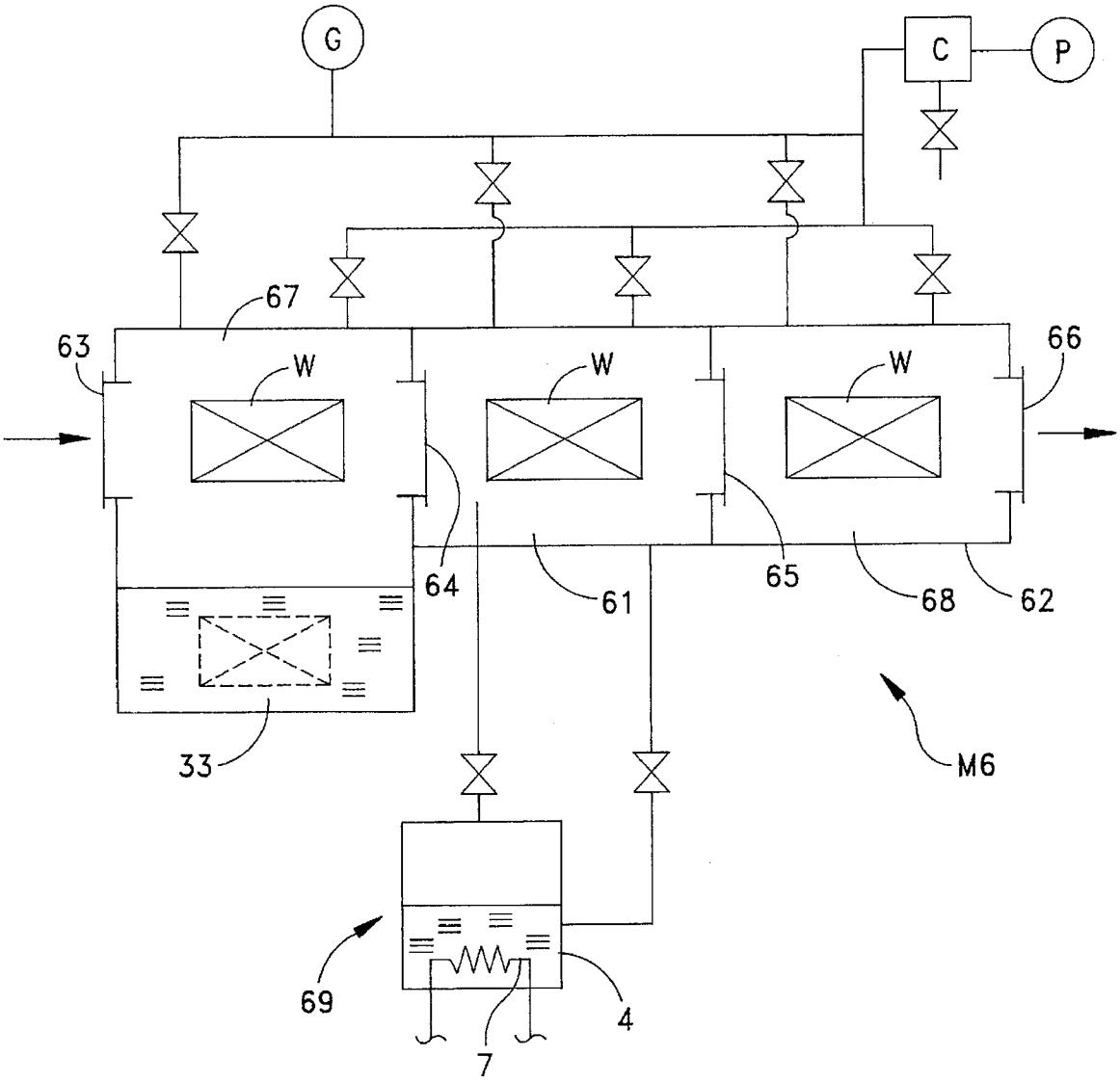
FIG. 7 is a schematic diagram showing a further vacuum cleaning machine.

The vacuum-cleaning machine M6 shown in FIG. 7 has its vacuum container 62 equipped with a carry-in door 63, intermediate doors 64 and 65 and a carry-out door 66. Moreover, the vacuum container 62 is partitioned into three chambers of a dipping/cleaning chamber 67, a vapor-cleaning chamber 61 and a drying chamber 68, and the dipping/cleaning chamber 67 is reserved therein with the dipping solvent 33. Moreover, a vapor generator 69 is connected to the vapor-cleaning chamber 61. Specifically, in case this vacuum-cleaning machine M6 is used, the work W is cleaned at three steps of dipping/cleaning step, vapor-cleaning step and drying step, and the multiple works W are consecutively transferred to the individual steps so that they may be cleaned.

In case this vacuum-cleaning machine M6 is used, the solvent 4 is heated in advance by the heater 7 to generate its vapor in the vapor generator 69.

First of all, at the dipping/cleaning step, the work W is placed on the not-shown table in the dipping/cleaning chamber 67 by opening the carry-in door 63. After this door 63 has been closed, the pressure in the dipping/cleaning chamber 67 is reduced to 5 to 100 Torrs. Then, the not-shown table is moved up and down several times to dip and clean the work W with the dipping solvent 33.

After the next vacuum-cleaning step, the pressure in the vacuum-cleaning chamber 61 is reduced to 5 to 100 Torrs, and the work W dipped and cleaned is placed on the not-shown table in the vapor-cleaning chamber 61 by opening and closing the intermediate door 63. After this, the righthand and lefthand solenoid valves V and V are opened. Then, the cleaning chamber 61 is filled up with the solvent vapor supplied from the lefthand solenoid valve V, to clean the work W with that vapor.

During this vapor-cleaning step, the dipping/cleaning chamber 67 is supplied with the nitrogen gas or the like from the inert gas source G to restore the atmospheric pressure. Then, the carry-in door 63 is opened and closed to carry the succeeding work W into the dipping/cleaning chamber 67. Moreover, the pressure in this dipping/cleaning chamber 67 is reduced to 5 to 100 Torrs to dip and clean the succeeding work W.

After the preceding work W has been cleaned with the solvent vapor in the vapor-cleaning chamber 61, it is transferred to the drying step. Specifically, the solenoid valves V and V are closed, and the pressure in the drying chamber 68 is reduced to 5 to 100 Torrs. Then, the intermediate door 65 is opened and closed to transfer the preceding work W to the drying chamber 68 to dry the surface of the work W. Then, the drying chamber 68 is supplied with the nitrogen gas or the like from the inert gas source G so that it restores the atmospheric pressure. After this, the work rinsing operation can be ended by opening the carry-out door 66 to carry out the cleaned work W.

During this drying step, the succeeding work W thus dipped and cleaned is transferred to the vapor-cleaning step so that it is cleaned with the vapor. After the preceding work W has been carried out of the drying chamber 68, the succeeding works W are sequentially transferred to the drying step so that they may be dried.

The tact time in the case of using this vacuum-cleaning machine M6 can be shortened to one third of that in the case of using the vacuum-cleaning machine M1. Moreover, the use of this vacuum-cleaning machine M6 can have a higher cleaning efficiency that the use of the vacuum-cleaning machine M1 because of the dipping and cleaning actions.

What is claimed is:

1. A method for degreasing and cleaning a workpiece comprising the steps of:

(a) placing the workpiece in a chamber of a degreasing and cleaning apparatus;

(b) reducing the pressure in the chamber;

(c) introducing vapor of a petroleum solvent into the chamber with a flashpoint higher than 70 degrees Celsius for cleaning the workpiece;

(d) dipping the workpiece in a bath of petroleum solvent;

(e) controlling the pressure in the chamber so that the amount of oxygen in the chamber is reduced thereby preventing the unwanted ignition of the vaporized petroleum solvent; and (f) drying the workpiece under reduced pressure.

2. A method as set forth in claim 1, said dipping step being accomplished in a separate chamber of the cleaning apparatus, said dipping step being performed in a first chamber and said cleaning of the workpiece with said petroleum solvent being accomplished in a second chamber.

3. A method as set forth in claim 2, said drying step comprising the steps of removing said petroleum solvent from said second chamber, and introducing an inert gas from an inert gas source of the cleaning apparatus into the second chamber.

4. A method as set forth in claim 3, said step of introducing the inert gas being accomplished in a third chamber.

5. A method as set forth in claim 4, said first, second and third chambers being sealed from each other.

6. A method for degreasing and cleaning a workpiece comprising the steps of:

(a) placing the workpiece in a chamber of a degreasing and cleaning apparatus;

(b) reducing the pressure in the chamber;

(c) introducing vapor of a petroleum solvent into the chamber with a flashpoint higher than 70 degrees Celsius for cleaning the workpiece;

(d) controlling the pressure in the chamber so that the amount of oxygen in the chamber is reduced thereby preventing the unwanted ignition of the vaporized petroleum solvent; and (e) drying the workpiece under reduced pressure, said drying step comprising the steps of removing said petroleum solvent from said chamber, and introducing an inert gas from an inert gas source of the cleaning apparatus into the chamber.

7. An apparatus for degreasing and cleaning a workpiece comprising:

a container having first and second chambers each adapted for receiving therein said workpiece, said chambers being sealable from one another wherein said first chamber has a petroleum solvent bath and is in fluid communication with a source of vaporized petroleum solvent;

means for dipping the workpiece in said bath of petroleum solvent in said first chamber for cleaning said workpiece;

means for reducing the pressure in said first and second chambers;

means for introducing said petroleum solvent vapor into the first chamber for cleaning the workpiece;

means for transferring the workpiece from the first chamber to the second chamber; and means for drying said workpiece in said second chamber.

8. An apparatus as set forth in claim 7, said means for reducing the pressure in the chambers comprising a vacuum pump in fluid communication with the chambers.

9. An apparatus as set forth in claim 8 further comprising means for controlling the pressure in the chambers comprising a valve in fluid communication between the vacuum pump and the chambers.

10. An apparatus as set forth in claim 7, said means for introducing the petroleum solvent in the first chamber comprising a source of petroleum solvent in fluid communication via a pipe with the first chamber.

11. An apparatus as set forth in claim 7, said means for drying the workpiece comprising a source of inert gas in fluid communication with the second chamber.

12. An apparatus for degreasing and cleaning a workpiece comprising:

a container having first, second and third chambers each adapted for receiving therein said workpiece, said first, second and third chambers being sealable from one another wherein said first chamber has a petroleum solvent bath and said second chamber is in fluid communication with a source of vaporized petroleum solvent;

means for reducing the pressure in said first, second and third chambers;

means for dipping the workpiece in said bath of petroleum solvent in said first chamber for cleaning said workpiece;

means for transferring the workpiece from the first chamber to the second chamber;

means for introducing said petroleum solvent vapor into the second chamber for cleaning the workpiece;

means for transferring the workpiece from the second chamber to the third chamber; and means for drying said workpiece in said third chamber.

13. An apparatus as set forth in claim 12, said means for reducing the pressure in the chambers comprising a vacuum pump in fluid communication with the chambers.

14. An apparatus as set forth in claim 13 further comprising means for controlling the pressure in the chambers comprising a valve in fluid communication between the vacuum pump and the chambers.

15. An apparatus as set forth in claim 12, said means for introducing the petroleum solvent in the second chamber comprising a source of petroleum solvent, separate from the second chamber, in fluid communication via a pipe with the second chamber.

16. An apparatus as set forth in claim 15 further comprising means for evacuating said petroleum solvent from second chamber comprising a pipe in fluid communication with said source.

17. An apparatus as set forth in claim 12, said means for drying the workpiece comprising a source of inert gas in fluid communication with the third chamber.

* * * * *